US007506597B2

(12) United States Patent
Morris

(10) Patent No.: US 7,506,597 B2
(45) Date of Patent: Mar. 24, 2009

(54) APPLICATION OF WAISTBANDS TO GARMENTS

(75) Inventor: Paul A. J. Morris, Rawdon Leeds (GB)

(73) Assignee: Pro-Fit International Limited, Leeds (GB)

( * ) Notice: Subject to any disclaimer, the term of this patent is extended or adjusted under 35 U.S.C. 154(b) by 483 days.

(21) Appl. No.: 10/496,046

(22) PCT Filed: Oct. 18, 2002

(86) PCT No.: PCT/GB02/04722

§ 371 (c)(1),
(2), (4) Date: Apr. 29, 2005

(87) PCT Pub. No.: WO03/034854

PCT Pub. Date: May 1, 2003

(65) Prior Publication Data

US 2005/0172875 A1 Aug. 11, 2005

(30) Foreign Application Priority Data

Oct. 20, 2001 (GB) ..... 0125288.1

(51) Int. Cl.
*D05B 23/00* (2006.01)

(52) U.S. Cl. ..... 112/470.33; 112/104; 112/113; 112/475.13

(58) Field of Classification Search ..... 112/104, 112/113, 120, 136, 147, 257, 470.33, 475.13, 112/305, 306, 312
See application file for complete search history.

(56) References Cited

U.S. PATENT DOCUMENTS 1,741,866 A 12/1929 Mann
1,836,742 A * 12/1931 Auerbach ..... 112/136
2,125,652 A * 8/1938 Seaman ..... 112/140
2,256,793 A * 9/1941 Seaman ..... 112/63
2,495,187 A 1/1950 Shames (Continued)

FOREIGN PATENT DOCUMENTS

FR 2 340 065 A 9/1977

(Continued)

*Primary Examiner*—Gary L Welch
*Assistant Examiner*—Nathan E Durham
(74) *Attorney, Agent, or Firm*—Howard & Howard Attorneys PLLC

(57) ABSTRACT

A method of attaching a waistband to a garment is disclosed which comprises providing a strip (26) of waistband fabric having outer portions more extensible than the centre section, and presenting the fabric to a sewing machine through a folder (18) for attachment to a garment, characterized in that the folder is angled to the sewing zone (16) whereby to force the outer sections of the waistband strip to proceed faster than the central section resulting in a curve being formed during attachment to the garment. Since the strip does not have a shape until it is treated in accordance with the invention, it may be provided on a reel for continuous operation. Moreover, the angle at which the folder presents the waistband to the sewing zone can be altered whereby to give shapes that are not of constant curvature. The folder may be mechanically linked using, for example, a pneumatic or hydraulic cylinder arrangement, to a knee-switch or foot-switch, to enable different degrees of curvature to be achieved at the operator's control.

4 Claims, 2 Drawing Sheets

U.S. PATENT DOCUMENTS

| | | | | | |
|---|---|---|---|---|---|
| 2,506,325 | A | * | 5/1950 | Ackerman | 112/138 |
| 2,801,602 | A | * | 8/1957 | Sigoda et al. | 112/140 |
| 2,818,826 | A | * | 1/1958 | Sigoda | 112/136 |
| 3,121,412 | A | | 2/1964 | Greco | |
| 3,515,081 | A | * | 6/1970 | Miller | 112/470.33 |
| 3,745,588 | A | * | 7/1973 | Pehle et al. | 2/221 |
| 4,128,066 | A | * | 12/1978 | Peloggio | 112/27 |
| 4,184,439 | A | * | 1/1980 | Schulz | 112/147 |
| 4,280,421 | A | * | 7/1981 | Price | 112/147 |
| 4,739,718 | A | * | 4/1988 | Effinger et al. | 112/140 |
| 4,744,317 | A | * | 5/1988 | Cullen et al. | 112/147 |
| 4,765,172 | A | * | 8/1988 | Seese et al. | 112/147 |
| 5,072,677 | A | * | 12/1991 | Easom et al. | 112/470.33 |
| 5,385,107 | A | * | 1/1995 | Borgne | 112/138 |
| 5,394,813 | A | * | 3/1995 | Shimoyama et al. | 112/470.31 |
| 5,598,798 | A | * | 2/1997 | Ng | 112/141 |
| 5,715,765 | A | * | 2/1998 | Ng | 112/141 |
| 5,941,187 | A | * | 8/1999 | Rouleau et al. | 112/475.03 |
| 6,566,285 | B1 | * | 5/2003 | Morris et al. | 442/184 |

FOREIGN PATENT DOCUMENTS

| | | | |
|---|---|---|---|
| FR | 2 624 141 | A | 6/1989 |
| GB | 2239876 | A * | 7/1991 |
| WO | WO 99/52386 | * | 10/1999 |

* cited by examiner

APPLICATION OF WAISTBANDS TO GARMENTS

The present invention relates to a method of applying strips of fabric to form waistbands to the top of garments such as skirts and trousers, and it particularly relates to a method and apparatus enabling the waistband to e up a curved or other non-linear shape during attachment to the garment.

Conventional waistbands may be attached to a garment manually by an operator, or automatically where the operator is not required to handle the waistband during application. In the latter case, the waistband is generally a continuous length of fabric, optionally fused with an interlining, which is fed through a folder to the sewing zone. It is desirable for more than one waistband to be presented in a continuous manner and in conventional operations there can be, for example, thirty waistbands fed from one reel.

While it is technically possible to convey shaped parts (which have been sewn into a partial curve) through a specially shaped folder, in general only small degrees of contour can be handled in a practical manner. Furthermore, the design and configuration of shaped waistbands is often irregular in that the shapes are not necessarily sections of circles but may include sections which arm straight or of a different curvature. Moreover, it is impractical to have pre-shaped and sewn parts fed continuously off a reel.

The present invention seeks to provide a method and apparatus improved in the above respects.

According to the present invention, there is provided a method of attaching a waistband to a garment which comprises providing a strip of waistband fabric having outer portions more extensible than the centre section, and presenting the fabric to a sewing machine through a folder for attachment to a garment, characterised in that the folder is angled to the sewing zone whereby to force the outer sections of the waistband strip to proceed faster than the central section resulting in a curve being formed during attachment to the garment.

The invention further comprises a sewing machine provided with a folder angled to the sewing zone whereby to carry out the method of the invention.

The strip which will form the waistband has outer sections more extensible than the centre. These may be produced, and preferably are produced, in accordance with the methods and apparatus disclosed in one or more of our patent publications EP 0705356, WO01/11132 and EP 1071349, although strips having his characteristic however produced may be used in accordance with the invention. Since the strip does not have a shape until it is treated in accordance with the invention, it may be provided on a reel for continuous operation.

Moreover, the angle at which the folder presents the waistband to the sewing zone can be altered whereby to give shapes that are not of constant curvature. The folder may be mechanically liked using, for example, a pneumatic or hydraulic cylinder arrangement, to a knee-switch or foot-switch, to enable different degrees of curvature to be achieved at the operator's control.

The greater the angle that the folder makes with the sewing the zone, the greater the curvature of the shape taken up. Conversely, the lesser the angle, the lesser the curvature. The greater the curvature desired, the more mechanically extensible the outer sections of the folded strip need to be to avoid distortion at the exit of the folder and entry to the sewing zone.

The invention will be described further, by way of example, with reference to the accompanying drawings, in which.

Figure 1:
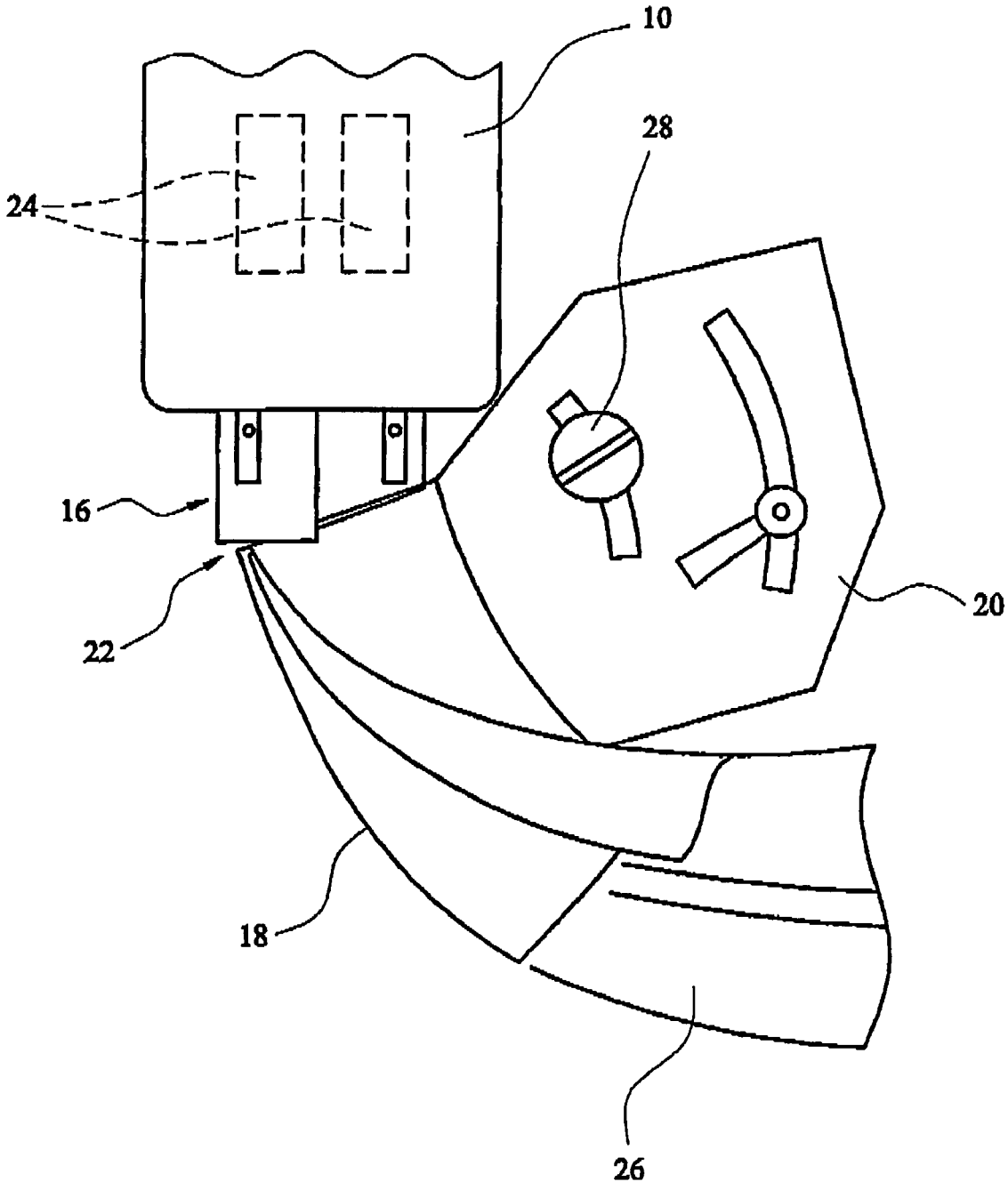
FIG. 1 is a diagrammatic plan view of an apparatus in accordance with the invention.
Figure 2:
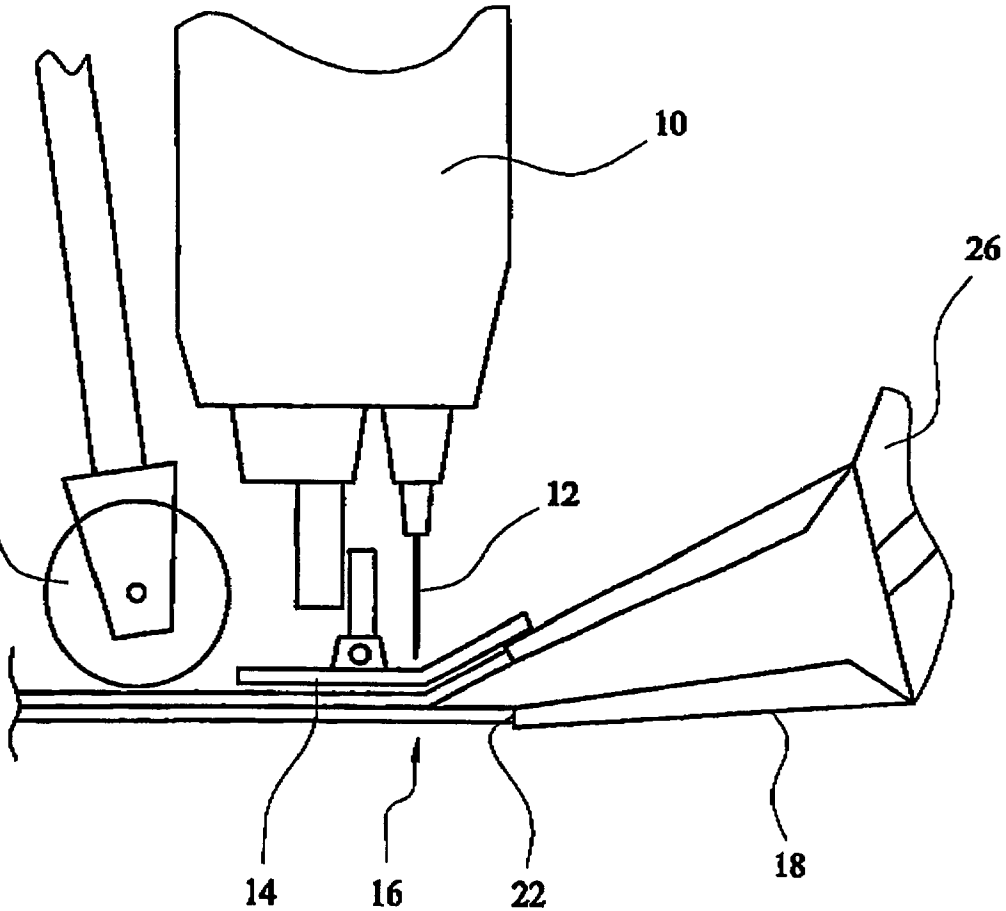
FIG. 2 is a side view corresponding to FIG. 1.
Figure 3:
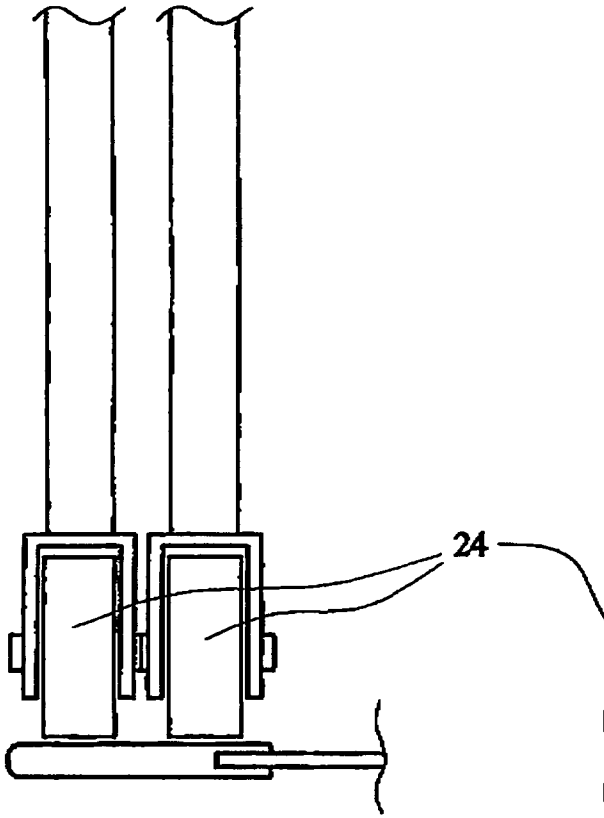
FIG. 3 is a rear view corresponding to FIG. 2.

Referring to the drawings, a sewing machine head (10) carries one or more needles (12) and a presser foot (14) as known per se. The area where the needles (12) stitch fabric is the sewing zone (16).

An angled folder (18) is fixed to an adjustable base plate (20) attached to the sewing machine. The exit (22) of the folder (18) delivers a waistband into the sewing zone (16) as will be discussed more fully hereinafter.

Downstream of the sewing zone (16) are mounted a pair of rollers (24), which optionally may be independently driven, which stabilise the work piece as it leaves the sewing zone (16).

A strip of fabric (26) from a reel (not shown) is fed into the folder (18) whereby the fabric is folded as known per se to form a waistband for a garment to which it is to be attached in the sewing zone (16).

The angle of the folder (18) to the sewing zone (16) is adjustable by means of an adjusting screw (28). Alternatively, the base plate may be connected, for example pneumatically, to a knee-switch to allow the operator to adjust the angle of the folder, and thus the degree of curvature imparted to the waistband, during sewing.

Operation is as follows. A continuous strip of fabric (26) is taken from a reel and folded into the folder (18) which delivers the folded fabric into the stitching zone (16), where it is stitched by means of needles (12) to a garment such as a pair of trousers or a skirt forming a waistband therefor. The angle which the folder makes with the sewing zone (16) determines the amount of curve or shape given to the waistband. The fabric (26) is preferably produced in accordance with one of our above mentioned patent publications so that the outer portions are more extensible than the centre so that when folded by the folder (18) the outer portions can proceed faster than the central section, resulting in a curve being taken up. The shape is then stabilised by sewing to the garment in the sewing zone (16).

Since the strip (26) is not in itself non-linear, it can be applied continuously from a reel. Once each garment has had the waistband attached, the strip (26) is cut and the next garment processed.

The method and apparatus of the invention enable curved or other non-linear waistbands to be attached to garments in a continuous manner which has not hitherto been possible owing to the impracticality of reeling up curved or shaped waistband strips.

The invention claimed is:

1. A method of attaching a waistband to a garment which comprises the steps of:

providing a strip of waistband fabric having outer sections more extensible than a centre section, presenting the fabric to a sewing machine through a folder for attachment to a garment, angling the folder relative to a sewing zone to force the outer sections of the waistband strip to proceed faster than the centre section resulting in a curve being formed during attachment to the garment, and altering the angle at which the folder presents the waistband to the sewing zone during attachment of the fabric to the garment to incorporate shapes that are not of constant curvature.

2. A method as claimed in claim 1 wherein the strip which will form the waistband has outer sections more extensible than the centre section so that, when folded, one side is more extensible than the other.

3. A method as claimed in claim 1 further including the step of mechanically linking the folder to an adjustment device to enable different degrees of curvature to be achieved at an operator's control.

4. A method as claimed in claim 1 further including the step of stabilizing a work piece as the work piece leaves the swing zone by passing the work piece under a pair of rollers that are mounted downstream of the sewing zone.

* * * * *